US007230378B2

(12) United States Patent
Su

(10) Patent No.: US 7,230,378 B2
(45) Date of Patent: Jun. 12, 2007

(54) PLASMA DISPLAY PANEL AND METHOD OF DRIVING THEREOF

(75) Inventor: Yao-Ching Su, Hsin-Chu (TW)

(73) Assignee: AU Optronics Corporation, Hsinchu (TW)

( * ) Notice: Subject to any disclaimer, the term of this patent is extended or adjusted under 35 U.S.C. 154(b) by 271 days.

(21) Appl. No.: 10/916,420

(22) Filed: Aug. 12, 2004

(65) Prior Publication Data

US 2006/0033435 A1 Feb. 16, 2006

(51) Int. Cl.
*H01J 17/49* (2006.01)

(52) U.S. Cl. ..... 313/583; 313/582; 313/583; 313/585; 313/587

(58) Field of Classification Search ..... 313/582–587
See application file for complete search history.

(56) References Cited

U.S. PATENT DOCUMENTS 6,407,509 B1 * 6/2002 Ikeda et al. ..... 313/582
6,445,120 B1 * 9/2002 Kim et al. ..... 313/586
6,476,554 B1 * 11/2002 Snijkers et al. ..... 313/586
6,603,265 B2 * 8/2003 Ahn et al. ..... 313/586
2003/0173900 A1 * 9/2003 Inan et al. ..... 313/587
2006/0012303 A1 * 1/2006 Ishibashi et al. ..... 313/582

FOREIGN PATENT DOCUMENTS

JP 05234520 A * 9/1993
JP 2003257320 A * 9/2003

* cited by examiner

*Primary Examiner*—Mariceli Santiago
(74) *Attorney, Agent, or Firm*—Arent Fox LLP

(57) ABSTRACT

A display device for displaying images, having a plurality of cells formed by barrier ribs, and a front substrate with a dielectric material layer, such that the dielectric material layer includes a portion with thickness set larger than that of the surrounding dielectric material layer.

12 Claims, 10 Drawing Sheets

PLASMA DISPLAY PANEL AND METHOD OF DRIVING THEREOF

BACKGROUND OF THE INVENTION

1. Field of the Invention

The present invention relates to improvements in plasma display panels and to improvements in methods of driving plasma display panels. In particular, the present invention provides a plasma display panel (referred to hereinafter as "PDP") with an optimal cell structure such as a thickened portion of dielectric layer for each cell, and an improved driving structure for optimally driving a PDP.

2. Related Art

A cathode ray tube (CRT) has long been the display device for displaying images on a television. In a CRT display, a gun fires a beam of negatively-charged particles (electrons) inside a large glass tube. The electrons excite phosphor atoms along the wide end of the tube, which causes the phosphor atoms to light up. The video image is produced by lighting up different areas of the phosphor coating with different colors at different intensities. Although the CRT has long been used to display video images, it is bulky. In other words, in order to increase the screen width in a CRT display, the length of the tube must be increased as well in order to give the scanning electron gun room to reach all parts of the screen. Consequently, a CRT having a big screen is heavy and takes up a sizeable space.

The conventional PDP was introduced to overcome some of the drawbacks of the CRT display. Specifically, the conventional PDP provides a display device with a large display screen in the form of a flat panel display, and provides an image quality and performance equal to or superior to the CRT display.

What is desired in a PDP is a bright and clear image with a low consumption of power. Conventionally, this has not been easy to achieve, since the basic process of producing visible light by UV excitation of phosphor is rather marginal.

Alternating current (AC) PDPs have basically two types of discharge methods. The first type involves production of a surface discharge between coplanar electrodes. This requires a three-electrode structure, which is known to be stable and is quite popular. The second type involves production of a discharge between noncoplanar electrodes, or electrodes that are on opposite sides of the cell. This is a two-electrode structure and has a lower discharge voltage and higher efficiency. However, the two-electrode structure has a number of practical drawbacks, and has not come into common use as yet. Hence, improvement of the brightness and reduction of the power consumption have been, and remain important objectives of the three-electrode type of PDP. That is, the main design objective of this type of PDP is to improve the discharge efficiency, i.e. to increase the strength of luminescence per unit of injected energy.

FIG. 1 illustrates a top view of a conventional PDP 10. PDP 10 is a matrix device having a basic grid of individual cells 12, which are defined by closed shaped barrier ribs 14. Typically, each cell is dedicated to producing visible light in either the red, green or blue wavelengths, with a group of red, green and blue cells alternating throughout the cell structure. The specific configuration illustrated in FIG. 1 is variously referred to as a triangle, or delta configuration, describing the shape that is formed by a group of red, blue and green light-producing cells. One proposed improvement to PDP 10 of FIG. 1 includes thickening the front dielectric layer into a stripe pattern that is positioned toward the discharge gap. Since the discharge is no longer entirely on the surface, a higher efficiency can be achieved using lower discharge voltage.

FIG. 2 illustrates a top view of another conventional PDP structure, PDP 20, and is referred to as a hexagonal or honeycomb grid format PDP. Similar to FIG. 1, in FIG. 2 closed-shape barrier ribs 22 define cells 24 arranged in a delta configuration of color pixels. However in this case the barrier ribs 22, and therefore the cells 24, are hexagonally shaped. The triangle or delta configuration PDP is superior to conventional stripe PDP in higher resolution, lower discharge voltage, higher efficiency, and greater brightness.

Although there are differences between conventional PDP cell structures, the major problem besetting these conventional structures remains low efficiency. This is also referred to as the discharge efficiency, which is the strength of luminescence per unit of injected energy.

Accordingly, there is a need to optimize the efficiency of the PDP by improving the structure of the PDP such that it requires a minimal amount of power for good functionality.

SUMMARY OF THE INVENTION

It is an object of the present invention to provide a PDP with high discharge efficiency.

It is another object of the present invention to provide a PDP with individual cells having a thickened dielectric layer, which protrudes into the discharge space, closer to the phosphorus on the rear substrate.

It is a further object of the present invention to provide a PDP with data electrode and sustain electrode coplanar at the front surface.

To achieve the foregoing objects of this invention, the present invention provides a plasma display panel having a front substrate with a dielectric material layer, such that for each cell, the dielectric material layer includes a portion with thickness set larger than that of the surrounding dielectric material layer.

DESCRIPTION OF THE DRAWINGS

The accompanying drawings, which are included to provide a further understanding of the present invention and are incorporated in and constitute a part of this specification, illustrate examples of the present invention and together with the description serve to explain the principles of the present invention.

In the drawings.

DETAILED DESCRIPTION OF THE EXEMPLARY EMBODIMENTS

Reference will now be made in detail to the exemplary embodiments of the present invention, examples of which are illustrated in the accompanying drawings.

Figure 1:
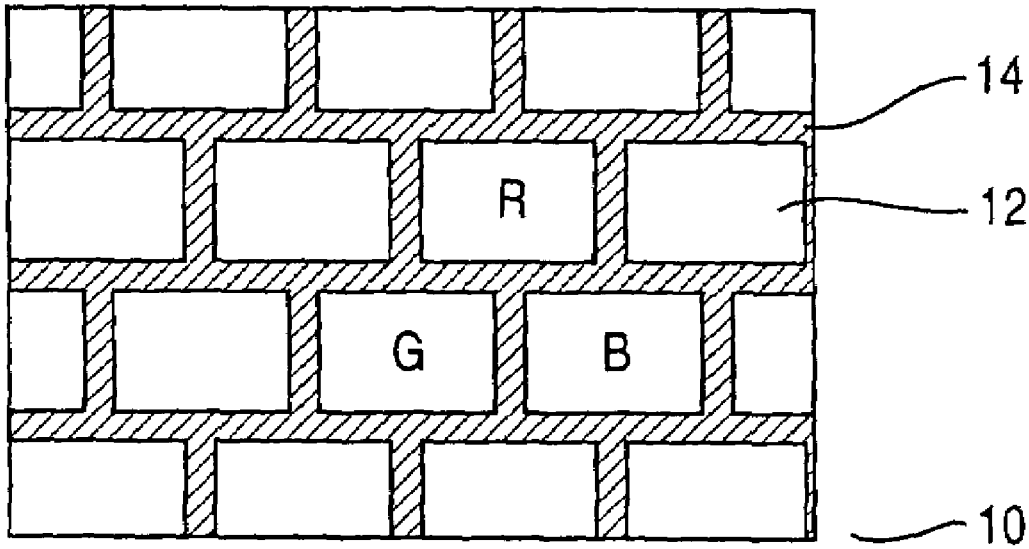
FIG. 1 illustrates a conventional plasma display panel having a delta color-pixel configuration.
Figure 2:
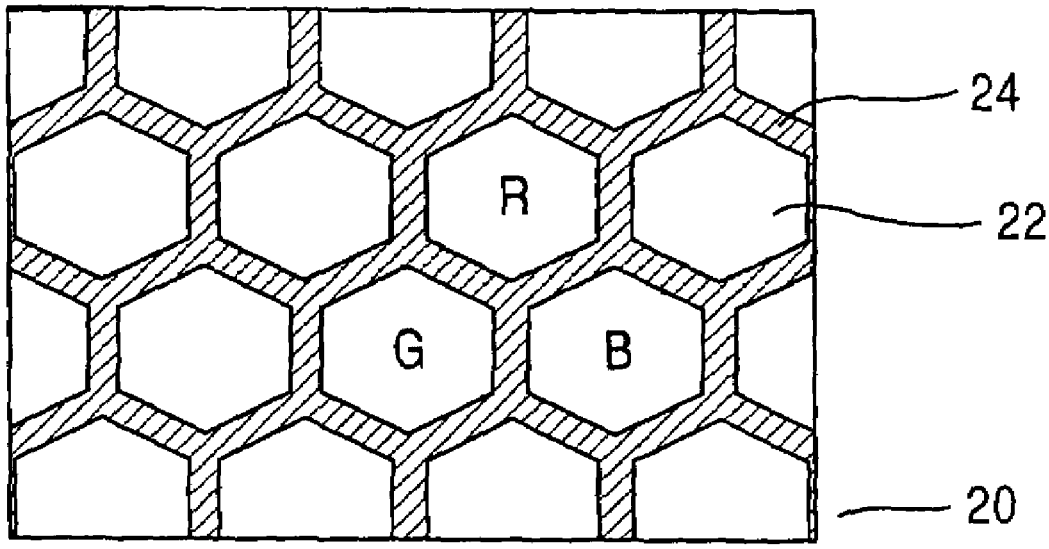
FIG. 2 illustrates a conventional plasma display panel having a delta color pixel configuration such that each cell has a hexagon or honeycomb shape.
Figure 3B:
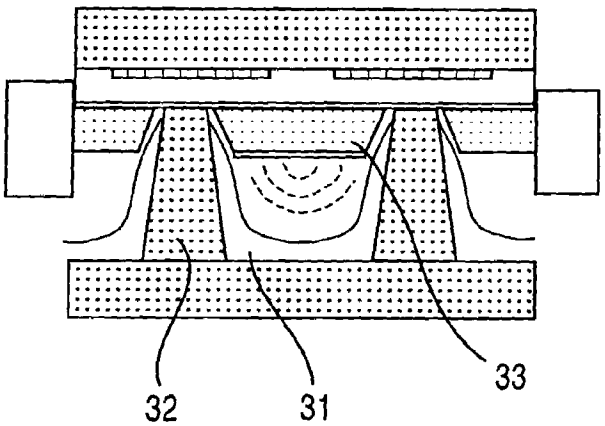
FIG. 3B illustrates a vertical sectional view of the first example of a PDP according to the principles of the present invention.
Figure 3A:
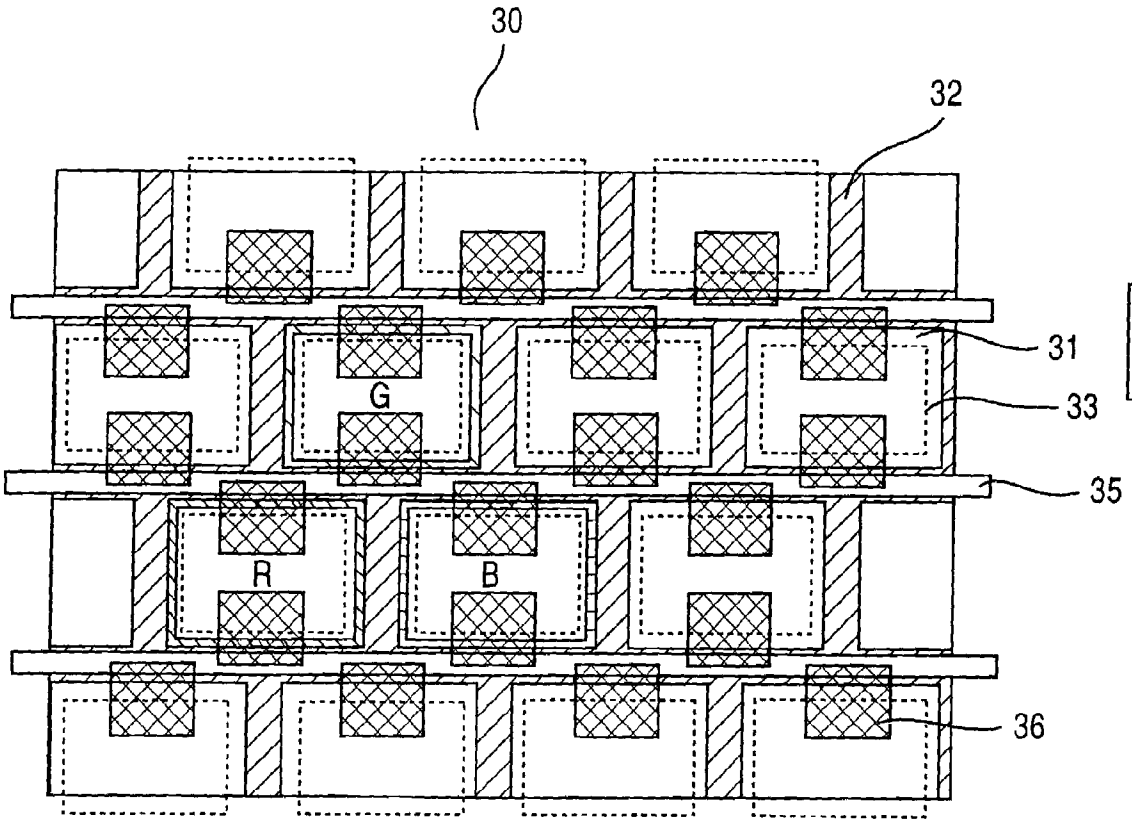
FIG. 3A illustrates a top sectional view of one example of a PDP according to the principles of the present invention.

FIG. 3A illustrates a top sectional view of a first example of the present invention. In particular, FIG. 3A shows a PDP 30 having a delta color-pixel configuration such that each cell 31 is rectangular shaped. FIG. 3A illustrates barrier rib wall 32 disposed on a rear plate such that the barrier rib wall 32 forms each cell 31 of the PDP 30, each cell 31 being a closed cell. In addition, the PDP 30 may include address electrodes (not shown) disposed on the rear plate.

The PDP 30 of FIG. 3A contains a plurality of row electrodes 34, which are themselves of two types. The first type of row electrode 34 is stripe shaped and is disposed along the width of the PDP 30. This stripe shaped electrode 35 portion of the row electrodes 34 is also referred to as the bus electrode portion of the row electrodes 35. These bus electrodes 35 are constructed of conductive metal.

Furthermore, the second type of the row electrodes 34 protrudes from the rectangular stripe bus electrode portion 35. In this example, the protruded electrode 36 of the row electrodes 34 is also rectangular shaped and is in contact with the bus electrode 35 along one side of the rectangular protruded electrode 36 and extends partly over the discharge area of the cells 31. The protruded electrode 36 is also referred to as the sustain electrode portion of the row electrodes 34. The sustain electrodes 36 are transparent and are constructed of a material such as a thin layer of metal oxide (ITO).

Shown in FIG. 3B is a vertical slice through FIG. 3A. The dielectric layer has a convex projection 33 which protrudes into the cell 31 created by barrier ribs 32. In this way, the plasma cluster or UV radiation is closer to the phosphor layer. This PDP design is still a surface discharge type design. The convex projection 33 can be either transparent or opaque; and it can be made of a variety of materials, which can be transparent dielectric, opaque dielectric, deflecting dielectric, or rib.

Note that in this example the convex projection 33 of the dielectric layer overlaps the sustain electrodes 36 approximately in the central portion of the sustain electrodes 36.

The convex projection 33 of the dielectric layer provides PDP 30 with the following characteristics. First, it provides a decrease in the discharge current required for plasma production, and secondly a reallocation of discharge toward the rear substrate, so that the resulting UV can excite the phosphor more efficiently. Shortening of the distance to the phosphorus results in a more efficient usage of the higher barrier rib structure, even without expanding the painted phosphor surface. As a result, it has become easier for the UV light to excite the phosphor, which therefore reduces erroneous discharges and avoids cross-talk between neighboring cells.

Figure 4B:
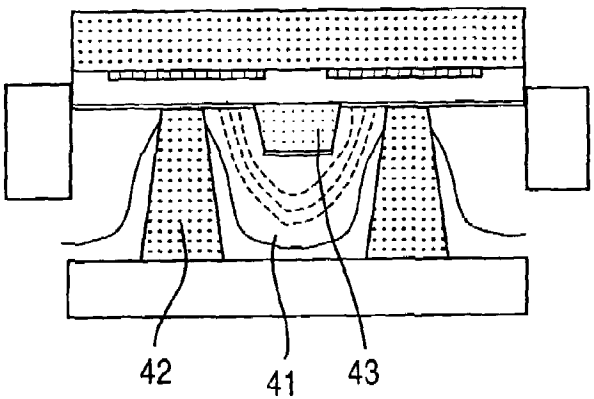
FIG. 4B illustrates a vertical sectional view of the PDP of FIG. 4A.
Figure 4A:
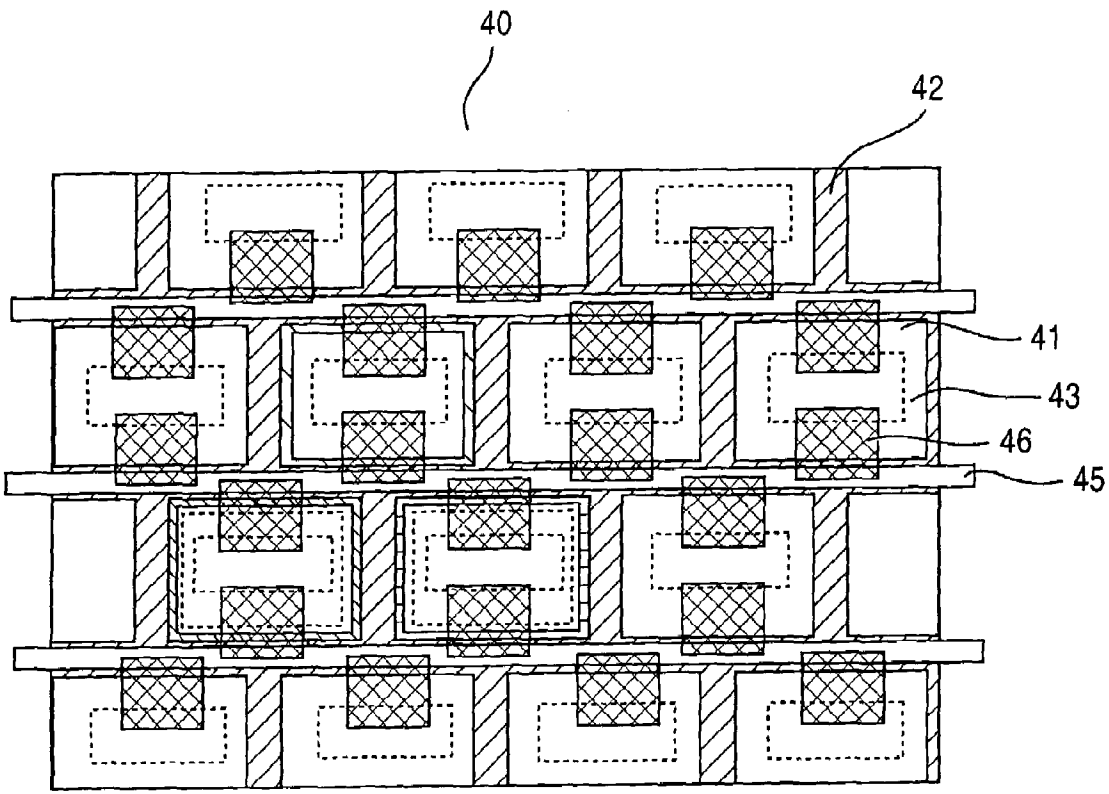
FIG. 4A illustrates a top sectional view of a second example of a PDP according to the principles of the present invention.

FIG. 4A shows a second example of the present invention. Barrier ribs 42 formed on the rear substrate define discharge cells 41, as in the previous examples. Row electrodes 45 have winged portions 46 projecting into the cells 41. The convex projection 43 of the dielectric layer can be shortened and fit into the discharge gap, which converts surface discharge into dielectric discharge. The convex projection 43 of the dielectric layer overlaps the transparent sustain electrode 46 only very slightly. Generally speaking, this dielectric structure results in improved efficiency and margin.

FIG. 4B shows a slice through FIG. 4A, and depicts the dielectric layer with a convex projection 43 which protrudes into the discharge space created by the barrier ribs 42. The convex projection 43 is more narrow in FIG. 4A than was shown previously in FIG. 3A. This sharper projection forces the plasma cluster or UV radiation even closer to the phosphor layer, thus further increasing the efficiency of the energy transfer.

Figure 5B:
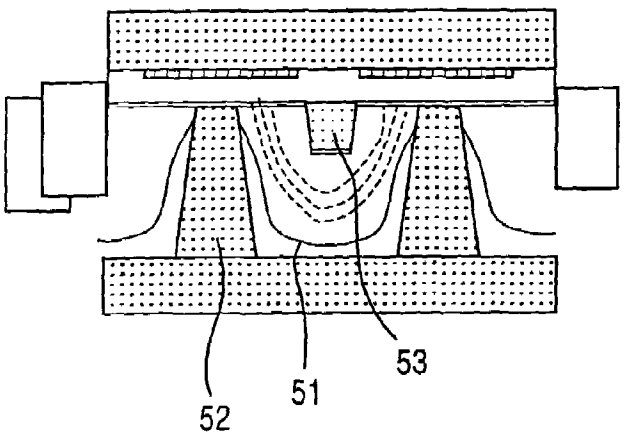
FIG. 5B illustrates a vertical sectional view of the PDP of FIG. 5A.
Figure 5A:
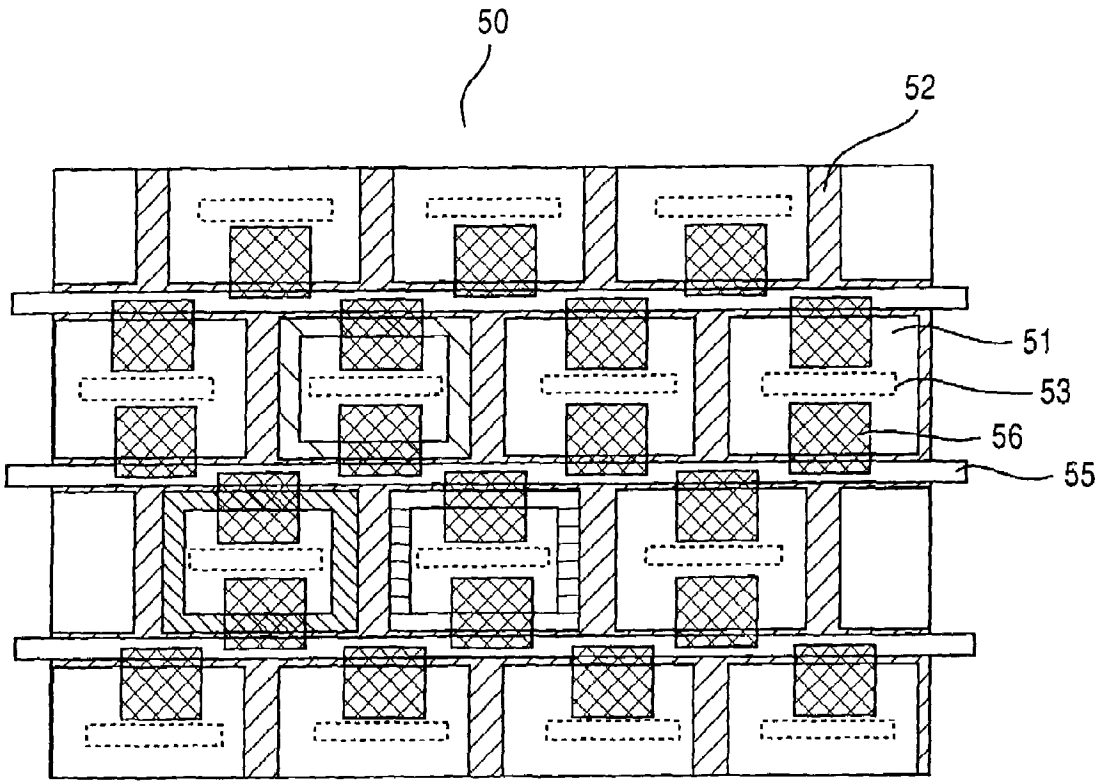
FIG. 5A illustrates a top sectional view of a third example of a PDP according to the principles of the present invention.

FIG. 5A shows a third example of the present invention. Barrier ribs 52 formed on the rear substrate define the discharge cells 51, as in the previous examples. Row electrodes 55 have winged portions 56 projecting into the cells 51. The convex projection 53 of the structure fits entirely into the denser discharge gap and does not overlap the transparent sustain electrodes 56.

FIG. 5B is a vertical slice through FIG. 5A, with the dielectric layer having an even sharper convex projection 53 which protrudes into the discharge space created by barrier ribs 52. In this way, the plasma cluster or UV radiation is forced even closer to the phosphor layer.

This thinner convex projection 53, if created by steel stamping using transparent dielectric materials, however, tends to be less technically accurate. In addition, contraction and extension factors should also be considered. Other methods can be adopted as well, such as spraying or melting.

Figure 6:
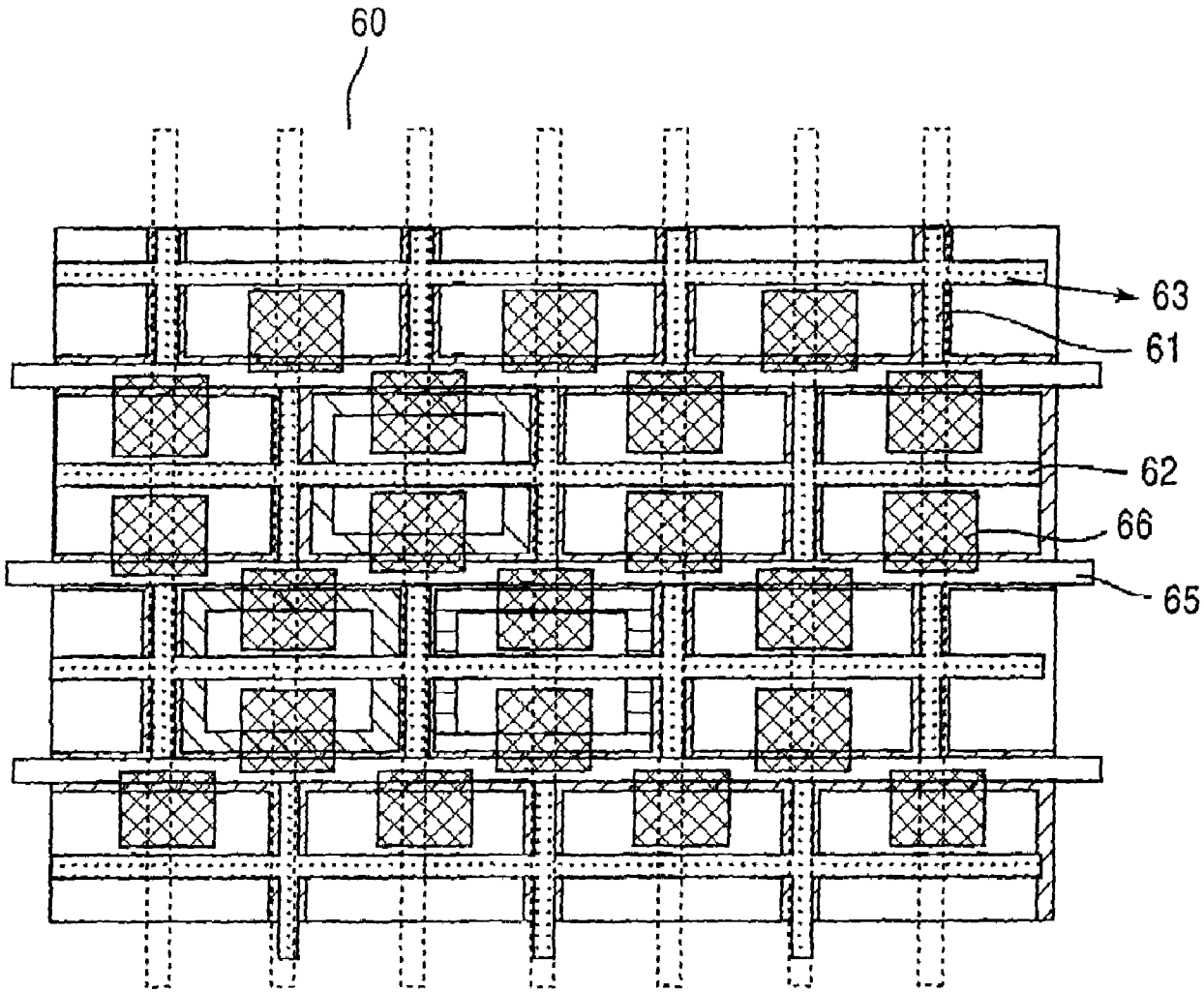
FIG. 6 illustrates a top sectional view of a fourth example of a PDP according to the principles of the present invention.

FIG. 6 illustrates a fourth example of a PDP according to the present invention. Barrier ribs 62 formed on the rear substrate define the discharge cells 61, as in the previous examples. Row electrodes 65 have winged portions 66 projecting into the cells 61. However, in this example the convex projection 63 is now stripe-shaped, thus creating a lattice pattern with the rear substrate barrier rib pattern oriented vertically plus the convex projection 63 oriented horizontally and passing through the central region of the discharge cells 61. The width of the convex projection 63 can be either equal to, thicker, or thinner than the barrier ribs 62. Usually, the thinner the convex projection 63 located in the discharge gap, the better.

Note that in FIG. 6, dielectric projection 63 includes a portion overlapping the rib pattern of the rear substrate and another portion at the discharge gap. This results in changing the characteristic of the discharge from that of a surface discharge to that of an opposite discharge. Opposite discharge designs have lower firing voltage, large operation margin and higher luminance efficiency than surface discharge designs. For a dielectric projection 63 having a height greater than about 30 um, the discharge characteristics could change to those of an opposite discharge design.

Figure 7B:
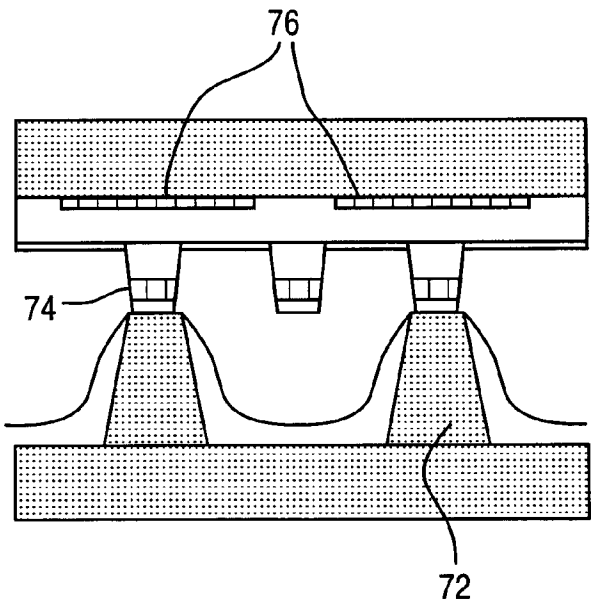
FIG. 7B illustrates a vertical sectional view of the fifth example of a PDP according to the principles of the present invention.
Figure 7A:
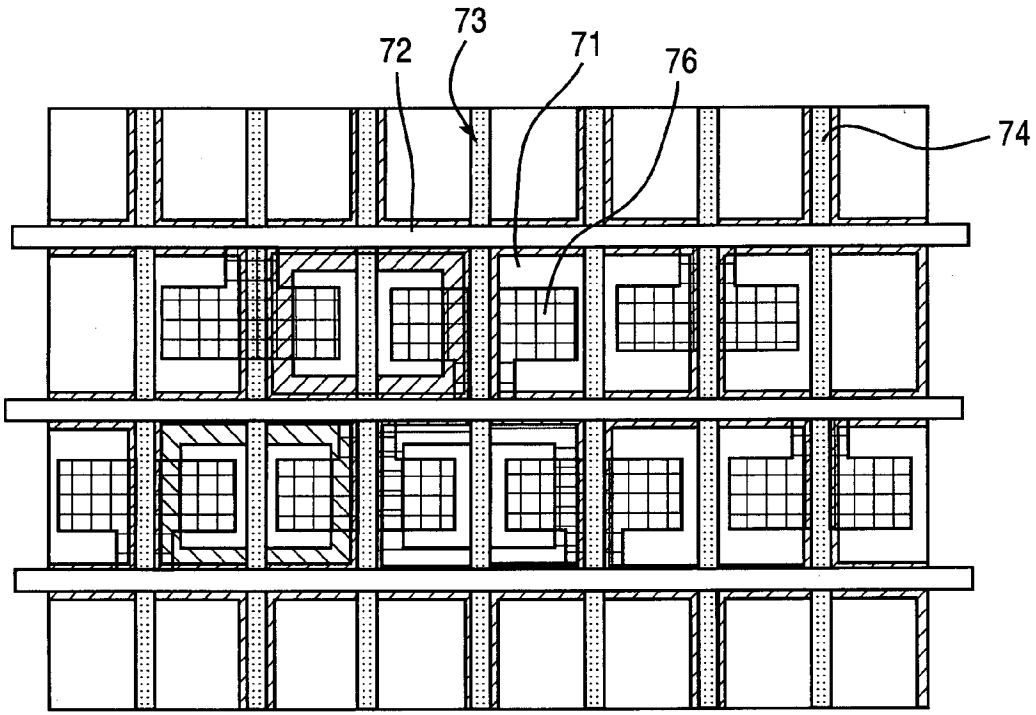
FIG. 7A illustrates a top sectional view of a fifth example of a PDP according to the principles of the present invention.

FIGS. 7A and 7B illustrate a fifth example of a PDP according to the principles of the present invention. Discharge cells 71 are formed by barrier ribs 72, with sustain electrodes 76 projecting into cell 71. The dielectric layer has projection 73, which in this example is stripe-like. In this example the data electrode 74 is formed on the front substrate 78 of the PDP, along the striped dielectric projections 73.

Figure 7C:
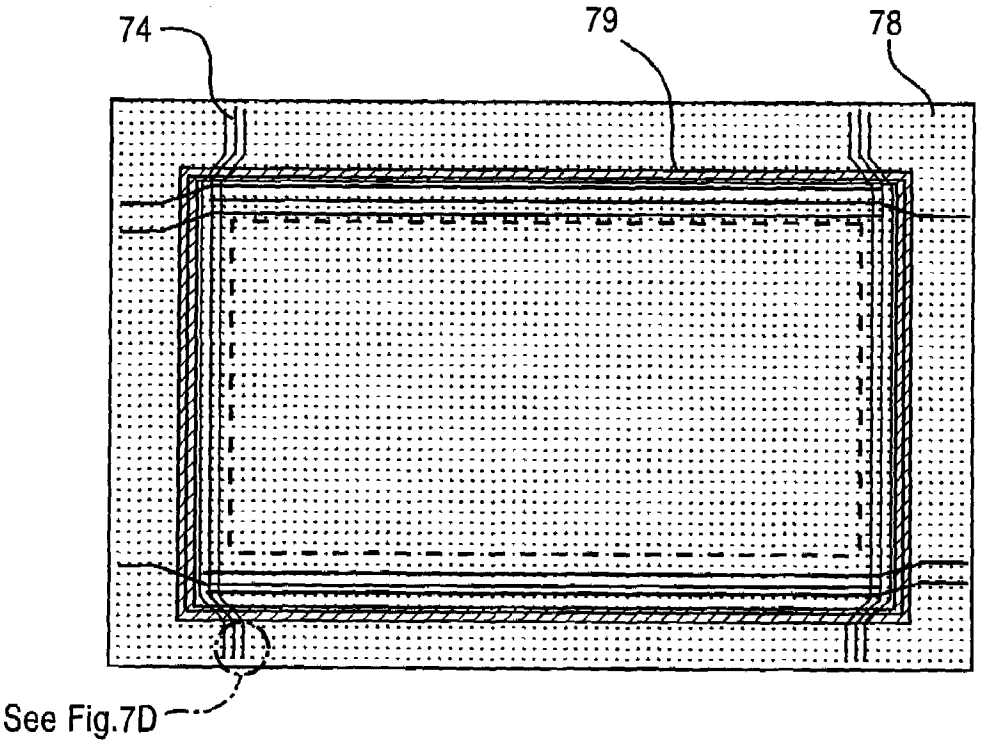
FIG. 7C shows a top sectional view of the fifth example of the PDP according to the principles the present invention.
Figure 7D:
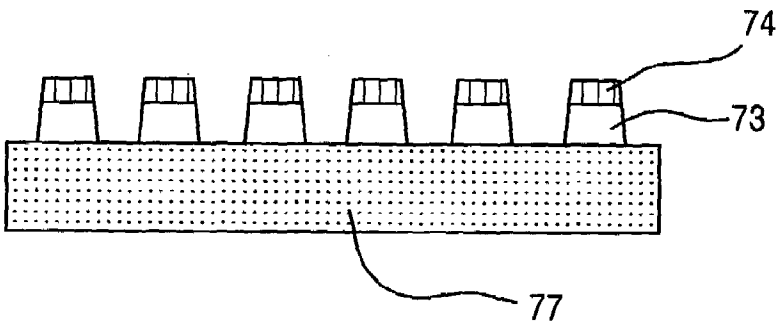
FIG. 7D shows a side view of the fifth example of the PDP according to the principles of the present invention.

FIGS. 7C and 7D show another view at the fifth example depicted in FIGS. 7A and 7B. FIG. 7C depicts a top view of the PDP where the front glass is smaller than the rear glass in the horizontal and vertical direction. FIG. 7D depicts a side view of the PDP. In FIG. 7D dielectric projections 73 are illustrated with data electrodes 74 mounted thereto.

Figure 8:
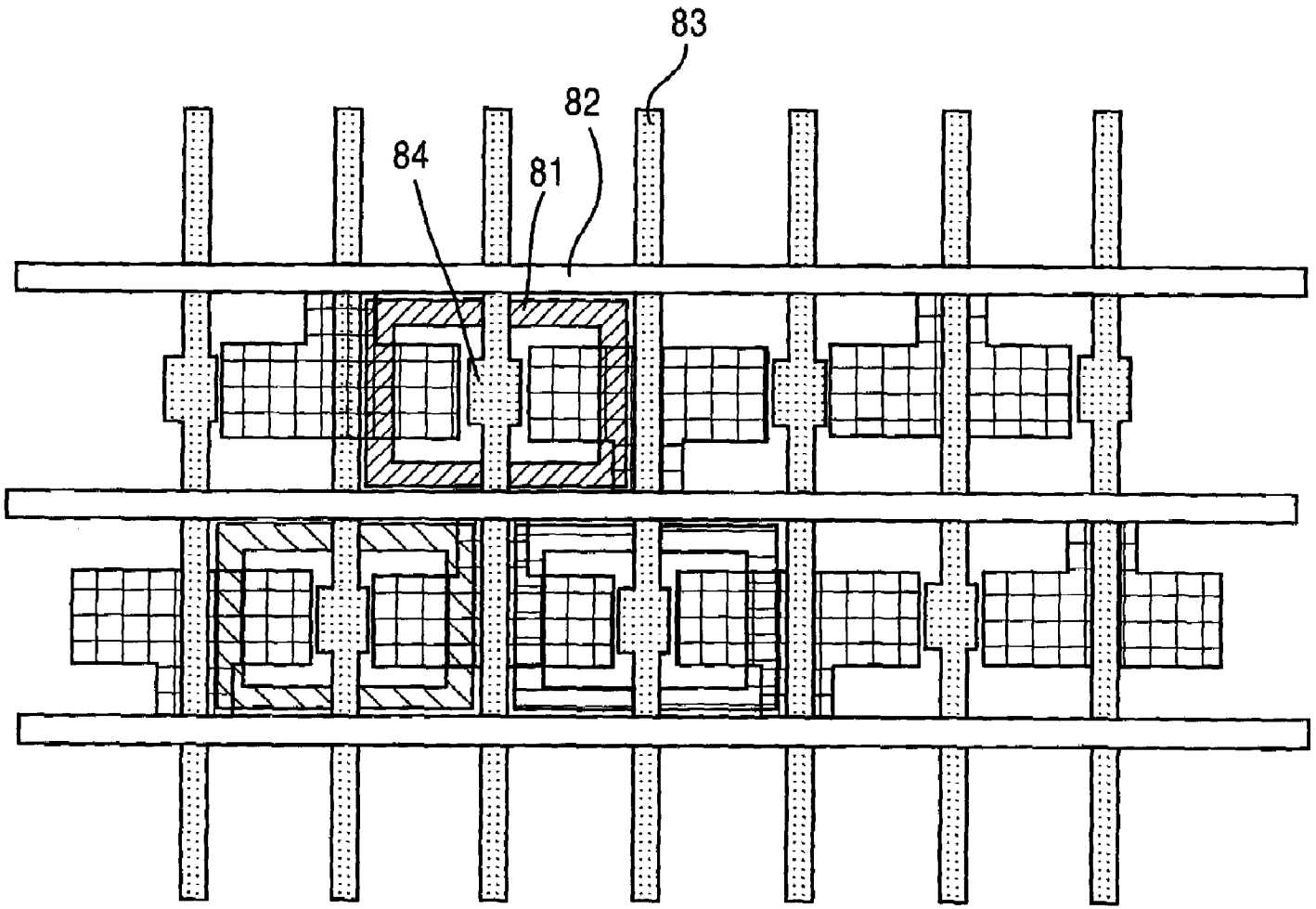
FIG. 8 illustrates a sixth example of a PDP according to the principles of the present invention.

FIG. 8 illustrates a sixth example of the present invention. Discharge cells 81 are formed by barrier ribs 82. The dielectric layer has a projection 83 which is stripe-like. Data electrode 84 is formed on the front substrate of the PDP and includes block portion 84 that could improve address margin and brightness on discharge cell. The discharge gap is parallel to direction of dielectric projection pattern 83. If discharge gap is not parallel to dielectric projection pattern that discharge could not raise.

Figure 9:
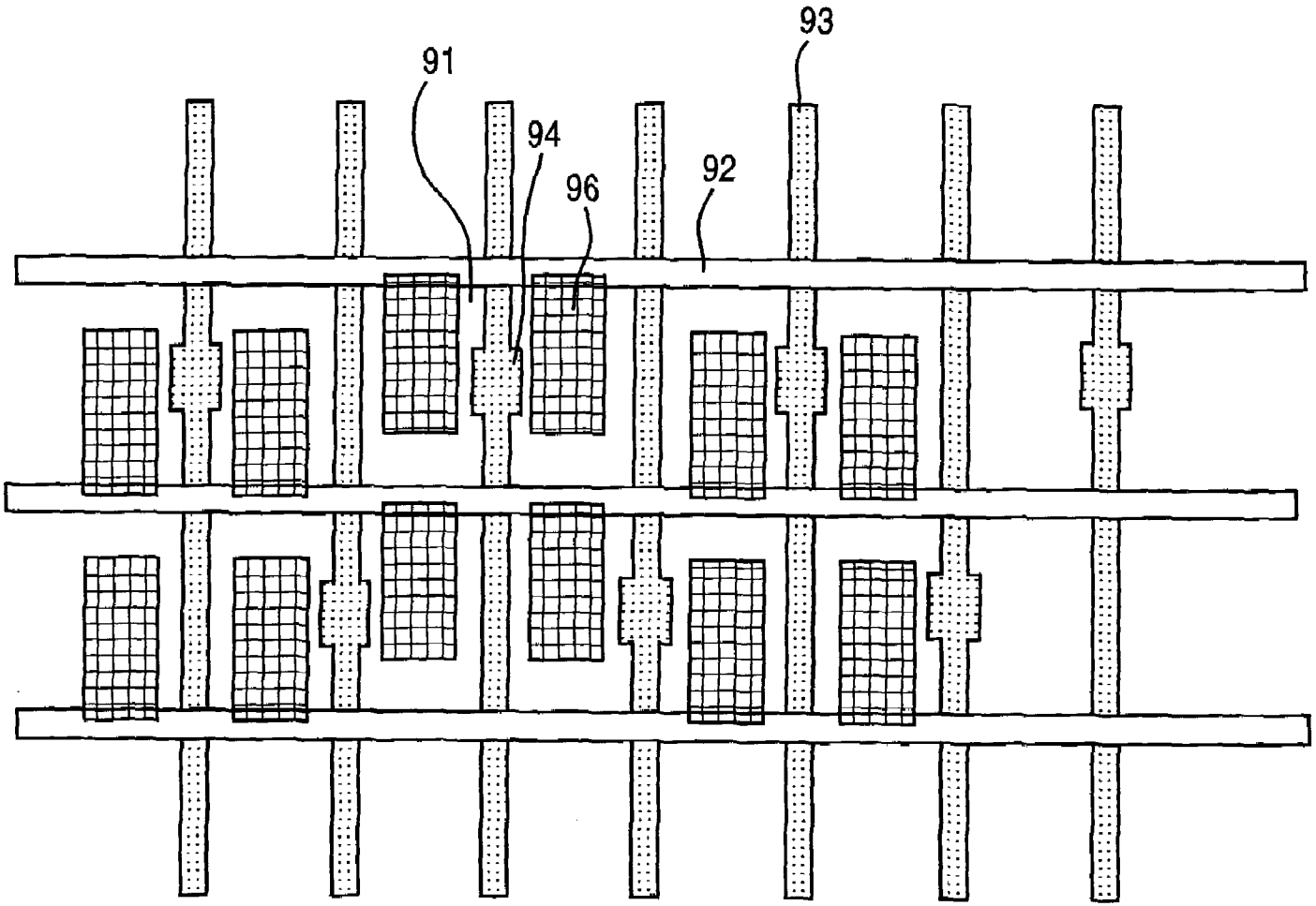
FIG. 9 illustrates a seventh example of a PDP according to the principles of the present invention.

FIG. 9 illustrates a seventh example of a PDP according to the principles of the present invention. Discharge cells 91 are formed by barrier ribs 92. The dielectric layer has a projection 93 which in this example is stripe-like. Data electrode 94 is formed on the front substrate of the PDP. In this example an alternative ITO pattern is illustrated, wherein the projections 96 are staggered pairwise in order to prevent the cross-talk between neighbor cell.

Figure 10:
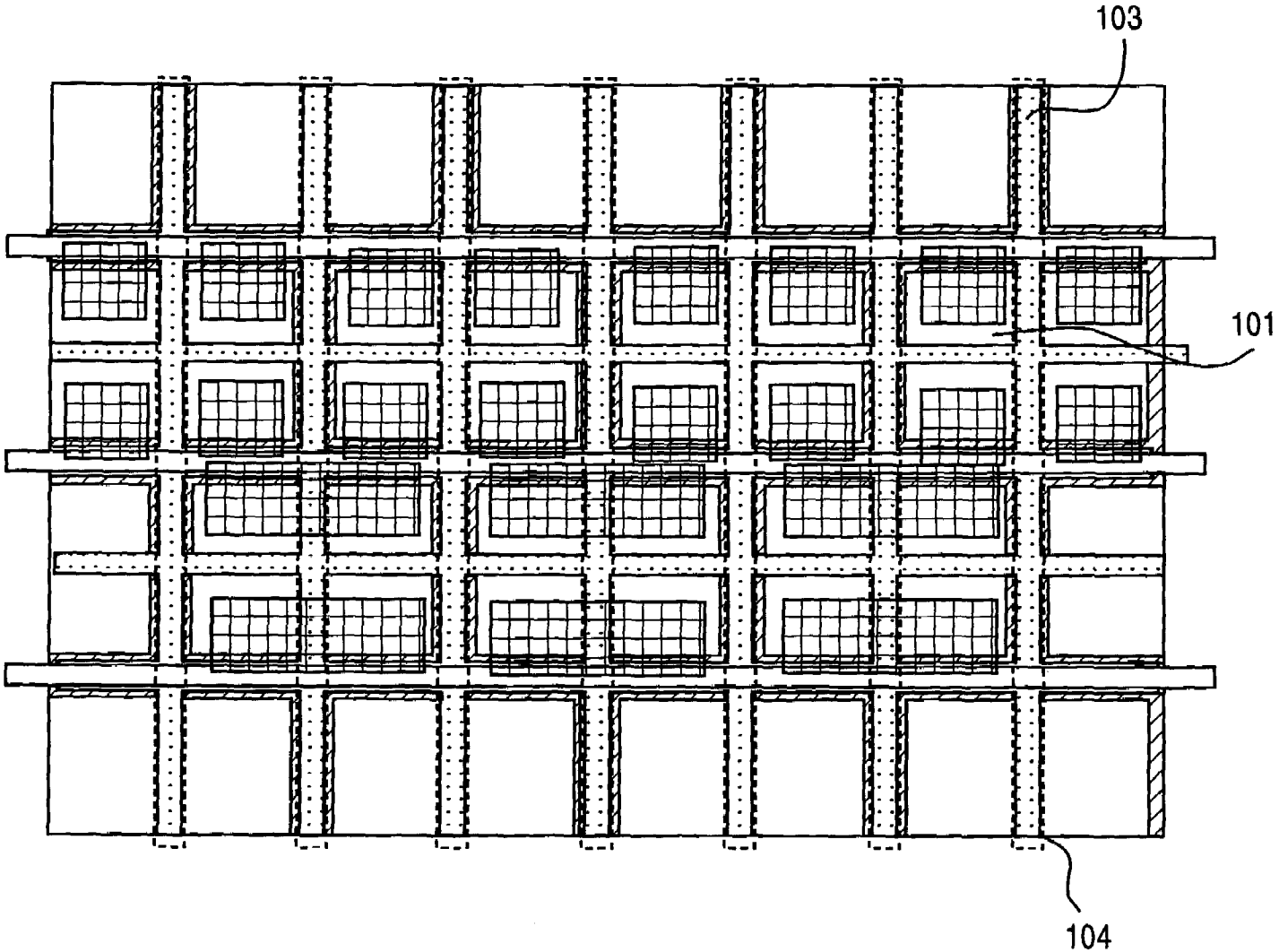
FIG. 10 illustrates an eighth example of a PDP according to the principles of the present invention.

FIG. 10 illustrates an eighth example of a PDP according to the principles of the present invention. Discharge cells 101 are formed by barrier ribs 102. The dielectric layer has a projection 103 which in this example is stripe-like. Data electrode 104 is formed on the front substrate of the PDP. In this example, the dielectric projection 103 is formed in a lattice-like pattern. Also, the data electrode 104 is formed in a stripe-like pattern and on the front substrate. Stripe-like shape could increase open ratio It will be apparent those skilled in the art that various modifications and variations can be made in the PDP of the present invention without departing from the spirit or scope of the invention. Thus, it is intended that the present invention cover the modifications and variations of this invention provided they come within the scope of the appended claims and their equivalents.

We claim:

1. A display device for displaying images comprising:

a plurality of rib walls;

a plurality of cells defined by the spaces between the rib walls;

a front substrate including a dielectric material layer, which forms the front of the cells;

such that the dielectric material layer includes a stripe pattern having thickness set larger than that of the surrounding dielectric material layer, and positioned in the row direction and passing through the central portion of the cells, and wherein a data electrode is positioned on the stripe pattern of the dielectric material layer of the front substrate.

2. The display device of claim 1, wherein the central portion of the dielectric material layer has a convex shape.

3. The display device of claim 1, wherein the front substrate further comprises a plurality of row electrodes.

4. The display device of claim 3, wherein the row electrodes each have winged portions which face a winged portion of the neighboring row electrode.

5. The display device of claim 4, wherein the winged portions of the row electrodes do not overlap the convex portion of the dielectric material layer.

6. The display device of claim 1, wherein a protective layer is positioned on top of the data electrode.

7. The display device of claim 1, wherein the data electrodes include block portions extending into the cells.

8. The display device of claim 1, wherein the cells are oriented in a delta configuration.

9. The display device of claim 8, wherein the central portion of the dielectric material layer has a convex shape.

10. The display device of claim 8, wherein the front substrate further comprises a plurality of row electrodes.

11. The display device of claim 10, wherein the row electrodes each have winged portions which face a winged portion of the neighboring row electrode.

12. The display device of claim 11, wherein the winged portions of the row electrodes do not overlap the convex portion of the dielectric material layer.

* * * * *